US005282325A

United States Patent [19]

Beyl

[11] Patent Number: 5,282,325

[45] Date of Patent: Feb. 1, 1994

[54] SHOE, NOTABLY A SPORTS SHOE, WHICH INCLUDES AT LEAST ONE SPRING SET INTO THE SOLE, CASSETTE AND SPRING FOR SUCH A SHOE

[76] Inventor: Jean Beyl, 10 boulevard Victor Hugo, 58000 Nevers, France

[21] Appl. No.: 962,731

[22] Filed: Oct. 19, 1992

[30] Foreign Application Priority Data

Jan. 22, 1992 [FR] France ..... 92 00644

[51] Int. Cl.[5] ..... A43B 13/28; A43B 21/30

[52] U.S. Cl. ..... 36/27; 36/38

[58] Field of Search ..... 36/27, 28, 37, 38, 7.8, 36/313

[56] References Cited

U.S. PATENT DOCUMENTS

| | | | |
|---|---|---|---|
| 357,062 | 1/1887 | Buch | 36/38 |
| 581,661 | 4/1897 | Heftye | 36/38 |
| 980,657 | 1/1911 | Meachum | 36/38 |
| 993,279 | 3/1911 | Scruggs | 36/38 |
| 1,328,816 | 1/1920 | Brown | 36/38 |
| 1,403,970 | 1/1922 | Lioy | 36/37 X |
| 1,469,920 | 10/1923 | Dutchak | 36/38 |
| 2,475,092 | 7/1949 | Harrell | 36/7.8 |
| 2,545,519 | 3/1951 | Kells | 36/38 |
| 3,886,674 | 6/1975 | Pavia . | |
| 4,492.046 | 1/1985 | Kosova | 36/27 |
| 4,756,095 | 7/1988 | Lakic | 36/28 X |
| 4,771,554 | 9/1988 | Hannemann | 36/27 |
| 4,843,737 | 7/1989 | Vorderer . | |
| 4,894,934 | 1/1990 | Illustrato | 36/37 |
| 5,159,767 | 11/1992 | Allen | 36/27 |

FOREIGN PATENT DOCUMENTS

| | | | |
|---|---|---|---|
| 0033492 | 1/1908 | Fed. Rep. of Germany | 36/28 |
| 16130 | 11/1981 | Fed. Rep. of Germany . | |
| 0008461 | 7/1841 | France | 36/37 |
| 0701729 | 5/1931 | France | 36/28 |
| 0909691 | 1/1946 | France | 36/28 |
| 2507066 | 12/1982 | France | 36/27 |
| 0633409 | 2/1962 | Italy | 36/38 |
| 228630 | 12/1943 | Switzerland . | |

OTHER PUBLICATIONS

UK Patent Application GB2200030A, (Koh) Jul. 27, 1988.

*Primary Examiner*—Paul T. Sewell
*Assistant Examiner*—Ted Kavanaugh
*Attorney, Agent, or Firm*—Cushman, Darby & Cushman

[57] ABSTRACT

The shoe shall include at least one spring (R), notably a metal spring, set into the sole between an upper plate (2) extending as far as the back of the shoe and a lower plate (3) to cushion the shoe from shocks from the ground. The upper plate (2) shall be rigid and shall be wholly located behind a line (L) underneath the metatarsus (4) of the foot; the sole shall present an area to allow for transversal articulation (5) in the area of this line (L) in such a way that the angle formed between the upper rigid plate (2) and the section of the sole (6) located in front of the area of articulation may vary; the lower edges of the sides of the uppers (9) of the shoe which cover the foot shall be joined to the upper rigid plate (2); the spring(s) (R, 11) shall be situated in the only part of the rigid plate which will be under the heel of the foot, the whole being such that variations in the load applied to the spring (R, 11) shall provoke an oscillating movement of the upper rigid plate (2) around a transversal line of articulation (L), in relation to the lower plate (3).

14 Claims, 3 Drawing Sheets

SHOE, NOTABLY A SPORTS SHOE, WHICH INCLUDES AT LEAST ONE SPRING SET INTO THE SOLE, CASSETTE AND SPRING FOR SUCH A SHOE

BACKGROUND OF THE INVENTION

1. Field of the Invention

The invention relates to a shoe of the type which includes at least one spring, notably a metal spring, set into the sole between an upper plate extending as far as the back of the shoe and a lower plate, to cushion the shoe against shocks from the ground.

2. Description of the Prior Art

The invention relates particularly to such a shoe, destined to be used for sport but which may also be used for everyday wear.

FR-A-958 766 shows a shoe of this type. In accordance with the illustrations in FIGS. 6 to 8, elasticity is provided by helical springs set in diverse places between the upper and lower plates. This arrangement of springs does not give good stability to the wearer of the shoe because it produces at element of 'floating' of the upper plate which would jeopardise the maintaining of stability. Furthermore, the natural movement of the foot upon the ground would not occur under favourable conditions. Finally, the production of such a shoe is relatively complex.

SUMMARY OF THE INVENTION

The aim of the invention is to supply a shoe of the type defined above which best responds, at present, to the diverse demands of use and which does not, or only to a small degree, present the inconveniences outlined above.

A further aim of the invention is to supply a shoe which will reduce rubbing of the wearers' foot against the upper covering the foot, notably at the back, despite the elasticity of the sole.

The invention aims also to supply a shoe in which it would be possible to set a particular type of spring designed to act as a damper over a reduced spring range of 6 to 7 mm.

The invention also aims to supply a shoe, the production of which would be simple and whose elasticity device may be incorporated into a cassette inserted into the sole of the shoe.

According to the invention, a shoe of the type defined above is characterised by the fact that: the upper plate is rigid and will be wholly located behind a transversal line destined to be located under the metatarsus of the foot; the sole will have a transversal zone to allow for transversal articulation in the area of this line in such a way that the angle formed between the plane of the upper rigid plate and the section of the sole located in the zone where articulation will occur may vary; the lower edges of the side of the upper which covers the foot shall be fixed, at the lower section to the upper rigid plate; the spring(s) is/are located on the only section of the rigid plate intended to be located under the heel of the wearer, the unit being such that when the load applied to the spring varies, there will be an oscillating movement of the upper rigid plate around the transversal line of articulation, relative to the lower plate.

With such a shoe, the sides of the upper covering the foot will move together with the rigid plate and with the foot, once the spring has been crushed by a variation in load, in such a way that rubbing of the wearers' foot, particularly in the area of the Achilles tendon, from the upper of the shoe, is almost completely eliminated.

Stability will be good because the only movement allowed consists essentially of a vertical movement of the heel, it being almost impossible for the upper rigid plate to rotate around a longitudinal axis.

The upper rigid plate may extend as far as the transversal line of articulation, which will form its front limit. Articulation may be effected in a flexible zone with the front part of the sole.

The upper rigid plate may be covered with a layer of a softer material.

The lower layer may also be rigid and its lower surface may be covered with a layer of a softer material which would be in contact with the ground.

The upper and lower plates, will advantageously, have transversal U-shaped sections, the concave faces of which will face each other, the wings of which fitting together to ensure lateral stability of the plates.

As a variation, and in particular for shoes of this type destined for everyday wear, the upper rigid plate will have a surface area limited to that of the heel of the shoe, whereas the lower plate will be of similar dimensions and will be mounted to allow clearance for vertical displacement in relation to the upper plate.

Another aspect of the invention gives the invention the following remarkable characteristics which may be employed alone or in combination with the above mentioned characteristics: the spring will be set more or less vertical to the wearers' heel of the foot, between the upper rigid plate and the lower plate next to the ground, and will consist of a torsion type spring which will be have at least one more or less horizontal axis coil set in a transversal direction, possessing a radial extension arm at each end, the two radial arms at each end together forming an angle, and the exterior of the coil being in contact with one of the plates whilst the ends of the arms will be in sliding engagement with the other plate, the coil approaching or moving away from the plate it is farthest from in a more or less orthogonal direction from this plate, whilst the angle between the arms increases or decreases according to the effect in variation of the load applied to the spring.

Advantageously the torsion type spring has two reverse direction concentric coils separated one from the other by a gap, the end arms being positioned radially toward the outside and linked by an arm which is parallel to the axis of the springs; the arms located internally may be extended and then the ends of them may be bent towards the middle again.

Preferably, the radial arms should have more or less the same radial dimension.

The working height of the torsion spring may be approximately 18 mm when it is not loaded and this spring will be designed so that in order to effect the first millimeter of reduction in its height, a load of approximately 35 dan should be applied. This will ensure a good recovery of energy.

It is preferable that the vertical spring range of the torsion spring is approximately 6 or 7 mm, in response to a doubling of the vertical load provoked when it is crushed for the first millimeter.

Advantageously, the shoe includes a triangular prism shaped cassette composed of a dihedron, the spring being placed between the faces of the dihedron pointing towards the far end of the angle, which end is designed to be slid, like a wedge, between a section of the upper sole and a section of the lower sole of the shoes, these sections of the shoes being joined at the edges by a sort of gusset going around the sole and the cassette and taking account of variations in height.

Motion stop devices have been included to limit the gap between the faces of the dihedron of the cassette, due to the action of the spring.

Preferably that the upper and lower rigid plates of the cassette should have U-shaped transversal sections, with the concave sections facing each other, the wings of which will fit together to ensure that the plates are held in position laterally.

The cassette may be positioned in such a way that it is more or less in the area of the metatarsus of the foot, whereas the spring in the cassette will be in the are of the heel.

Two cassettes placed in opposite directions, one at the front and one at the back, their angles adjacent to the region of the metatarsus, may also be placed in the same sole.

In the case of shoes designed for everyday wear which have a prominent heel, the cassette may be placed in the heel between upper and lower rigid plates.

The invention also pertains to such a cassette destined to be placed in the sole of a shoe. This cassette is also interchangeable, In the case of the sole of a shoe, the invention also pertains to a spring characterised by the fact that it has at least one coil, at each end of which there is an extension arm, the two radial arms forming an angle, the coil being designed to be in external contact with the one plate, whereas the ends of the arms are intended to move towards or away from the plate they are furthest from in a more or less orthogonal direction to the plate, whereas the angle between the arms increases and decreases due to the effect of the load applied to the spring.

Advantageously, the spring also has two concentric reverse direction coils, separated by a gap, the end arms being directed axially towards the outside of these coils and being linked by an arm which is parallel to the axis of the springs.

The radial arms will be more or less the same length.

It is preferable that one section of the radial arms of the spring is bent towards the outside, and that this section is in contact with a surface.

Apart from the descriptions given above, the invention also pertains to a certain number of other characteristics which will be described more fully below with reference to diagrams in the appendices, which should not be considered as exhaustive.

DETAILED DESCRIPTION OF THE INVENTION

Figure 1:
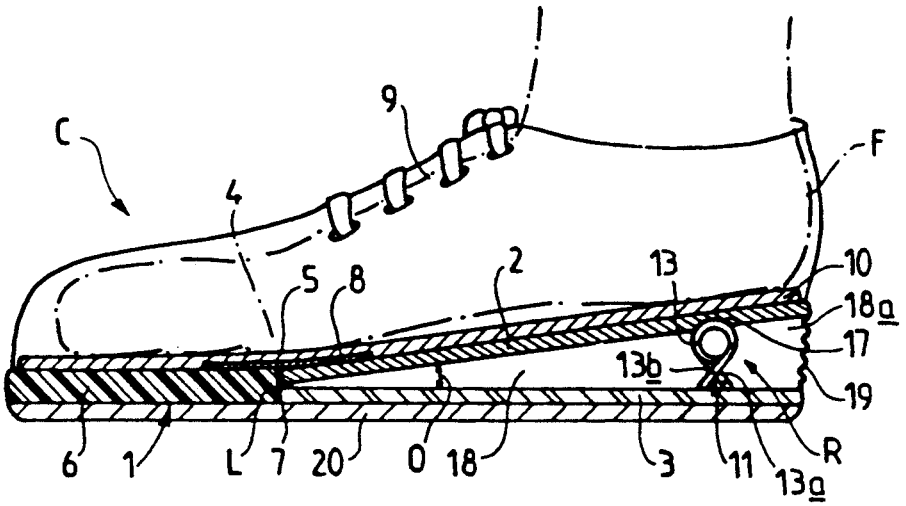
FIG. 1 of these diagrams shows a longitudinal view, showing outside sections, of a shoe made in accordance with the invention.

Before describing the shoe represented in FIG. 1, it is useful to make certain observations.

To cushion shocks to the heel from the ground, shocks which would be transmitted to the ankles, knees, thighs and spinal column we need to produce a shoe which possesses sufficient elasticity in the heel area.

The contact of the heel with the ground may be classified into three main categories:

- when making large strides, all the weight of the body rests on the heel; the area of the metatarsus of the foot of the wearer only touches the ground during the instant after the heel has made contact with the ground;
- with smaller steps, we consider that the whole of the base of the foot touches the ground; the metatarsus and the heel make contact at almost the same time with most wight being placed on the heel;
- when running, it is recommended that the front part of the foot makes contact with the ground first, then the foot flattens gradually thus ensuring an even distribution of energy and reducing fatigue.

With a view to finding the best method of cushioning shocks to the heel for the different types of contact mentioned above, as can be seen in FIG. 1, a shoe C, made in accordance with the invention, is fitted with a spring R set into the sole 1 between upper plate 2 extending as far as the rear part of the shoe, and in particular under the heel F of the wearer, and a lower plate 3. Plates 2 and 3 together form an angle 0.

The upper plate 2 is rigid and will, for example be made from a rigid plastic material and will have a low rubbing coefficient. This plate 2 is located behind a forward transversal limit L, shown as a perpendicular line on FIG. 1, situated in the area designed to be located under the metatarsus 4 of the foot. In the example shown in FIG. 1, the upper rigid plate extends as far as the limit L which constitutes its forward transversal edge.

A transversal zone of articulation 5 is planned, following the limit L, between the plate 2 and the section in front of 6 on the sole of the shoe whose construction may be as normal. In the example shown in FIG. 1, the lower plate 3 is also rigid and extends as far as the limit L. The area where articulation (5) will occur may include a transversal axis 7, made of metal for example, held in place by end plates composed of staples to be set into the lateral edges of plates 2 and 3. Furthermore, liaison between plate 2 and the section in front of 6 is ensured by a flexible band 8. Plate 3 is linked to the section in front of 6, also preferably by a flexible area.

The lower edges of the upper 9 of the shoe, which covers the foot F of the wearer, will be fixed around plate 2, on the upper edge of section 6.

The whole of plate 2 and the section in front of 6 of the sole will be covered with a thinner, relatively soft internal sole 10, which will extend the whole length of the shoe, in such a way that the foot does not feel any rough edges on seams.

Spring R is a torsion type spring 11; it will be located more or less vertical to the heel of the foot, between upper rigid plate 2 and lower plate 3 next to the ground.

Figure 2:
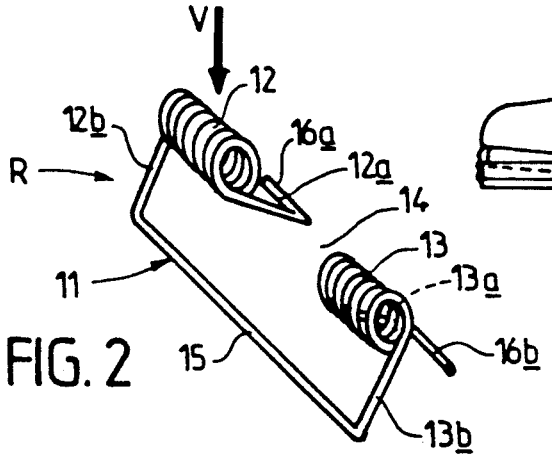
FIG. 2 shows a perspective, on a larger scale, of a spring set into the shoe shown in FIG. 1.

As can be better seen on FIG. 2, spring 11 has two reverse direction concentric coils, 12 and 13 separated from each other by a gap 14.

Each coil 12 and 13 has end arms 12*a*, 12*b*, 13*a*, 13*b*, forming an angle A and being more or less the same length.

Arms 12*b*, and 13*b* are located on the external ends of springs 12 and 13 and are parallel to each other whereas arms 12*a* and 13*a* are located at the internal ends of the coils 12 and 13, these arms also being parallel. External arms 12*b* and 13*b* are linked at their external radial ends by an arm 15 parallel to the axis of the coils.

Arms 12*a* and 13*a* point towards the inside and are bent towards the outside at their radial ends in accordance with hooks 16*a* and 16*b*.

Spring 11 is positioned in such a way that coils 12 and 13 are in contact on the outside with one of the plates, more or less following a generatrix. In the example shown, coils 12 and 13 are in contact with upper plate 2, whereas arm 15 and hooks 16*a* and 16*b* will slide against plate 3 which will be made from a low friction material.

The spring 11 will be held in position in relation to plate 2 in a longitudinal direction and where the axis of the coils will be transversal. There methods may be a transversal groove 17 with a circular concave profile which is moulded to the shape of the cylindrical surface of the coils 12 and 13. Spring 11 is slightly compressed between plates 2 and 3.

Of course, other methods of holding the spring in position may be used; it is important that the angular movement of arms 12*a*, 12*b* and 13*a* and 13*b* is not impeded once a load is applied to plate 2 causing spring 11 to be crushed.

Figure 3:
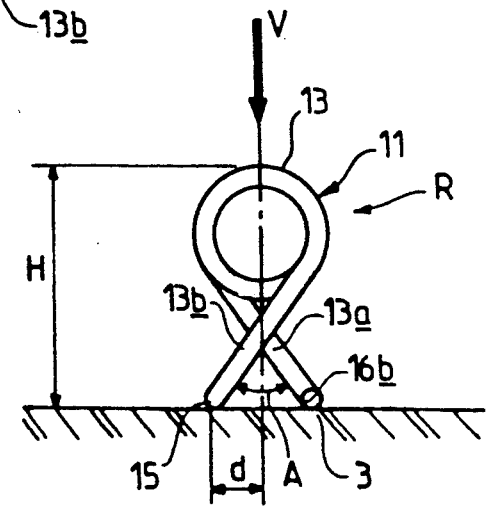
FIG. 3 shows an elevation, on a larger scale of a spring, made in accordance with the invention.

The gap between plates 2 and 3 and included between the articulation zone 5 and the spring 11 should be kept free of any materials in order that the plate 2 may make angular movements in relation to plate 3, by moving around the articulation zone 5 when there are variations in the working height of the spring H. This working height H, as may be seen in FIG. 3 is equal to the distance between the tangent area of contact outside coils 12 and 13. Of course, the gap 18*a* located behind the spring 11 should also be kept free of all other material.

Advantageously, height H measures 18 mm when spring 11 is not loaded, and spring 11 is designed in such a way that as soon as height H has been reduced by one millimeter, the load, and thus the reaction caused by this spring is approximately 35 dan. Furthermore, spring 11 is designed in such a way that height H will be about 6 or 7 mm when the load which causes the first reduction in height of 1 mm is doubled. Angle A will be approximately 60° in the resting position so that the angle between the end radial arms 12*a*, 13*a*, or 12*b*, 13*b* and the vertical is approximately 30° (A/2).

As can be seen from FIG. 3, the forces exerted on arm 15 and on hooks 16*a* and 16*b* in response to a vertical load V applied to the coils, create a torsional moment on the said coils the size of which depends on lever arm d equal to the distance between the contact zone on plate 3, and the vertical passing through the axis of coils 12 and 13.

The length of lever arm d is more or less proportional to sin A/2.

Lever arm d augments once crushing of the spring commences, which occurs simultaneously with the augmentation of the action of coils 12 and 13 due to an increase in torsion. This augmentation in the length of lever arm d decreases the action of the coils.

With coils whose external diameter is 10 mm and whose initial height is 18 mm, lever arm d will almost double by 6 mm of compression, to give an angle of A/2 of 30° at rest.

The external contours of lower plates 2 and 3 are linked by a flexible lining, similar to a gusset, designed to absorb oscillating movements of plate 2 in relation to plate 3.

The lower surface of plate 3 may be covered with a layer 20 of a softer material, which will also extend underneath section 6 of the shoe in such a way that it only forms a single layer.

Figure 6:
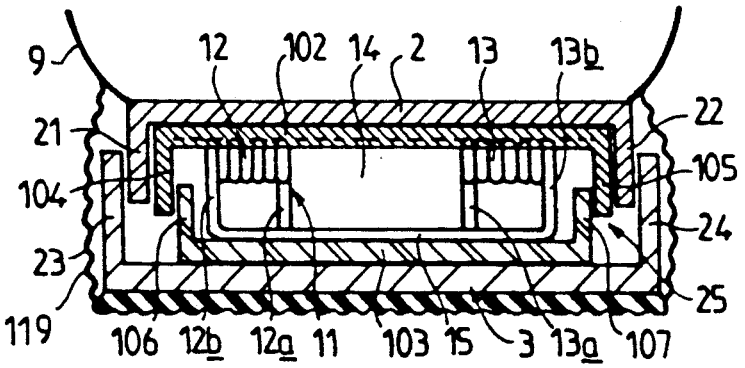
FIG. 6 shows a transversal section of the sole and gives a detail of the heel of a shoe made in accordance with the invention.

As can be seen from FIG. 6, plates 2 and 3 should preferably have a transversal U-shaped section the concave sections of which should be facing each other. The concave section of upper plate 2 should be turned to face the bottom and wings 21 and 22 of this section, and should be more or less vertical, and should be held between wings 23 and 14 which should be turned towards the top of lower plate 3. Even when spring 11 is not loaded, the lower edge of wings 21 and 22 should be above the lower edge of wings 23 and 24. When operational, this will thus ensure good lateral stability between plates 2 and 3 thanks to co-operation between wings 21 and 22 and wings 23 and 24, any play between these wings being reduced.

The functioning of the shoe to which the invention pertains results directly from the explanations above.

Spring 11 is tared in such a way as to absorb, from the very beginning of its displacement, for example when the first reduction in height H of one millimeter has been achieved, a load which corresponds more or less to half the weight of the wearer.

When the wearer is walking or running, the load is transferred from one foot to the other. Spring 11, beneath the foot which is bearing the load will be crushed in such a way as to absorb this load; plate 2 as well as the internal sole 10 will oscillate around the transversal axis of articulation 5, whilst the angle 0 is reduced.

Once the load on the foot in question has been reduced, spring 11 renders the energy absorbed and returns to its resting position.

It should be noted that the lower edge of upper 9 follows the movements of plate 2 and that the foot F should be completely encased in the shoe and forms the body of the shoe together with internal plate 10 and plate 2. Because of this, during movements of plate 2 there will be no relative displacement between the foot F and the upper 9, which will almost eliminate rubbing.

It would not be the same if vertical elasticity was achieved inside the shoe, as this would produce rubbing from top to bottom and from bottom to top of the foot, especially on the heel, and the internal section of upper 9 of the shoe.

Furthermore, according to the invention, holding the foot in the shoe by lacing it up, or by any other equivalent means, remains the same during vertical displacement of the foot, whereas in a shoe where vertical elasticity is achieved inside the shoe, holding the foot, especially by lacing it in, varies all the time.

In accordance with the invention, articulation of the foot will be effected around the area of the metatarsus of the foot, the gap 18 of the sole allowing the whole of plate 2 to oscillate.

The special design of torsion type spring 11, which works by reducing its height in proportion to the gap between its end radial arms is important.

Because the load, from the time of the first one millimeter of compression in a downwards direction is more or less equal to half the wearers' body weight, the latter will be supported without vertical "slack" once the weight of the body is equally distributed between the two feet, when stationary. This high spring load, is crucial to allow the spring to ensure a good return of energy from the beginning of compression.

In spite of this high load, once compression has begun, the spring only achieves a 6 mm reduction in height H when the load is doubled.

In a classic compression spring, the load achieved after 6 mm of crushing would be more or less equal to six times the load obtained after 1 mm of crushing.

Furthermore, double coiled torsion spring 11 in the invention, will take up almost the whole width of the heel of the shoe which will contribute to giving good lateral stability, the axis of the coil being placed horizontally. If classic compression springs were used, several springs would be required.

It should be noted, that in shoes where other methods of cushioning are used in the heel, supple materials such as elastomer or similar, are very supple at the commencement of crushing, from which point, due to a lack of lateral stability they harden very quickly at the end of crushing.

For walking and running, given the rapid unbending of the heel/foot to flat/front of the foot or front of the foot/foot to flat/heel, the hardness of spring 11 must be well adapted but not too strong. because cushioning must occur progressively, without any hard points being encountered. With springs where the external diameter of the coils was 10 mm, height H in the resting position was 19 mm and with the arms at 30° (A/2=30°) in the resting position, with the possibility of going to 90° (A/2=90°) on completion of crushing, good results were obtained with 2.4 mm stainless steel wire.

For sports involving a lot of jumping, harder springs should be used.

Figure 5:
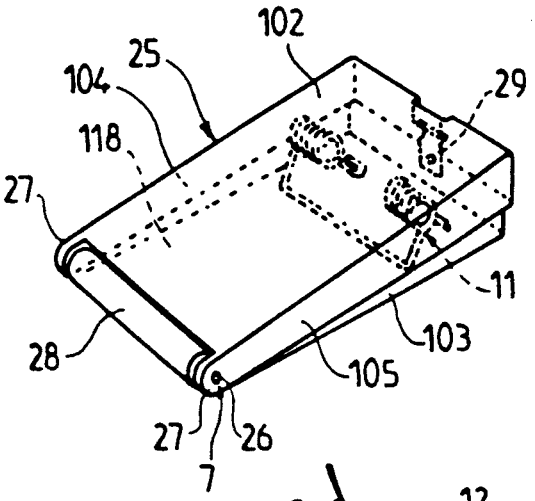
FIG. 5 shows a diagram in perspective of a cassette designed to be set into the sole of a shoe.

If we refer to FIG. 5, we see that spring 11 may be placed in a cassette 25, more or less in the form of a triangular prism or a wedge, made up of a dihedron composed of two rigid plates, 102 and 103. Plates 102 and 103 form the faces of the dihedron and are articulated in accordance with the angle of the dihedron around a transversal axis 7, made, for example, from a metallic pin.

Axis 26 should be placed more or less under the metatarsus 4 of the foot, whereas the spring 11 should be placed between the faces 102 and 103 of the dihedron facing towards the back, where should be fixed by any appropriate method.

More precisely, upper plate 102 has a transversal U-shaped section, the concave section of which should face downwards, as shown on FIG. 6, and including lateral wings 104 and 105 which should extend downwards, should be more or less vertical.

Lower plate 103 also has a transversal U-shaped section, where the concave section faces the top, the edges of which are limited by vertical lateral wings 104 and 105, with reduced play. Co-operation between the lateral wings of wings 102 and 103 ensures transversal stability of one plate in relation to the other.

As can be seen on FIG. 5, lateral wings 104 and 105 of the upper plate have, at the front end, a lug as in 27 around a scalloped edge in the front edge of upper plate 102. Each lug will have a hole in it which will serve as an end plate for the axis 26.

Lower plate 103 bears a cylindrical tube 28 forming a transversal front edge set between the lugs at 27. This tube has a central bore through which axis 26 passes.

A fixing lug 29 is included behind plate 103 to work with a stopping device behind plate 102 to keep the cassette closed at the resting position. the spring 11 being prestressed by 1 mm. The whole is such that even when the cassette is not loaded, the lateral linings 104, 105, and 106, 107 will cover each other in accordance with the range.

Plates 102 and 103 are made from a rigid plastic material, with a reduced rubbing coefficient.

The gap 118 between the axis 26 and the spring 11 of the cassette 25 shall be free of all material like the gap 18 in FIG. 1.

Cassette 25 will be slid, like a wedge, between a section of the upper and lower soles of the shoe, the upper and lower sections of the sole providing a flexible area beneath the metatarsus of the foot, an area in which the articulation of the cassette 26 will occur. The edges of the sections of the lower and upper soles of the shoe will be joined by a sort of gusset similar to the gusset at 19 in FIG. 1. This gusset should be fixed in such a way that it is removable, in order to allow the cassette 25 to be replaced by a cassette of the same type, but with a spring whose hardness is different. As a variation, the cassette may be put in place through the underneath or through the inside of the shoe.

Changing the cassette allows for adaptions to be made in accordance with the use of the shoe. For example, one day the shoe may be used for walking and another day it may be used for a sport entailing frequent jumping.

Of course, the lower edge of the upper 9 is fixed to the upper sole in such a way that once the spring is rushed there is no movement between the upper 9 and the foot.

The section of the upper sole may include the plate at 2 described in FIGS. 1 to 3, and represented on FIG. 6, whereas the section of the lower sole may include plate 3, also represented on FIG. 6. The external faces of wings 104 and 105 of plate 102 of the cassette are, almost in contact with the internal faces of wings 21 and 22 of plate 2.

Because plates 102 and 104 of the cassette are rigid, we could eliminate rigid plates 2 and 3 from the sole of the shoe; in this case, the upper and lower sections of the sole should be entirely made from a supple material.

A shoe furnished with such a cassette functions as explained above, and presents the same advantages as those described for FIGS. 1 to 3.

The description given up to now concerns mostly a sports shoe such as would be used for walking, running or tennis, the lower sole surface being almost completely flat, without the heel being prominent.

Figure 7:
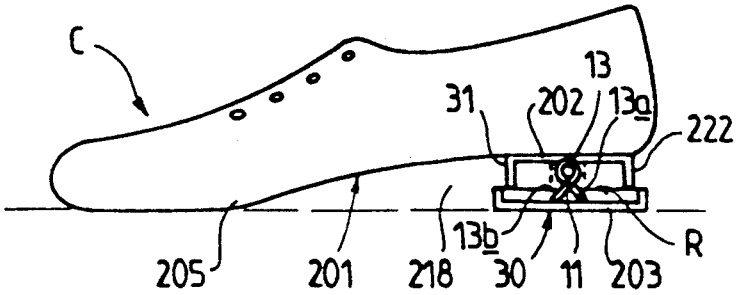
FIG. 7 shows a side view, certain parts being shown in section, of a show designed to be used for everyday wear.
Figure 8:
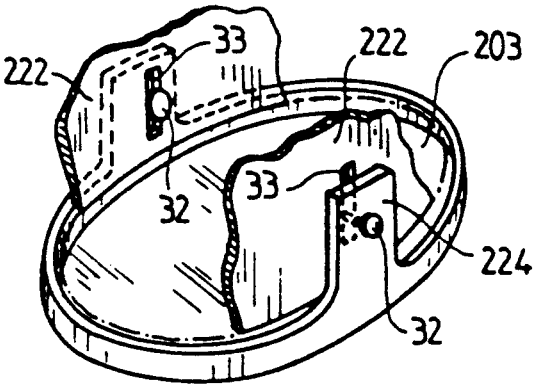
FIG. 8 shows a diagram in perspective of a detail of the show shown in FIG. 6, on a larger scale.

As shown in FIG. 7, a shoe C made in accordance with the invention, may be used for everyday wear, with a prominent heel 30, jutting out at the bottom, whereas the sole 201, which is flexible especially under the metatarsus, will leave contact with the ground to come up to the upper level of the rear section of the heel. There is therefore a gap 218 between the area of articulation 205 and the heel.

In the case of FIG. 7, the surface of the upper rigid plate 202 has a surface area limited more or less to that of the heel. It extends to the rear of the shoe, but, at the front is limited by a transversal edge 31 located at the rear of the area of articulation 205.

The edge of the plate 202 has lining which is more or less vertical and extends down to the bottom. Lower plate 203 is also rigid and is mounted to allow for vertical movement in relation to plate 202. It is held laterally between plates 202 and 203 thanks to the presence of vertical sides 224 on the edges of plate 203, and extending to the top, which works together with side 222.

Liaison between upper plate 202 and lower plate 203, may be ensured by transversal slugs 32 which are held in vertical oblong openings 33 in the side 222 of plate 202. The vertical slugs at 32 also allow for relative oscillation between plates 202 and 203 around a transversal axis, and furthermore, for a more or less vertical displacement between these plates.

The spring 11 is set between plates 202 and 203, more of less vertical to the foot, this spring 11 being held in place with any appropriate method.

When the shoe is not being used, plates 202 and 203 are kept apart by the maximum distance possible, the slugs at 32 being held against the lower openings 33 at the end.

Side wall linings 222 and 224 are designed to allow a certain freedom of movement during vertical displacement whilst still remaining set one in another when no load is being exerted on the heel of the shoe.

The functioning of a shoe made in accordance with FIG. 7 is similar to that described for preceding Figures.

Figure 9:
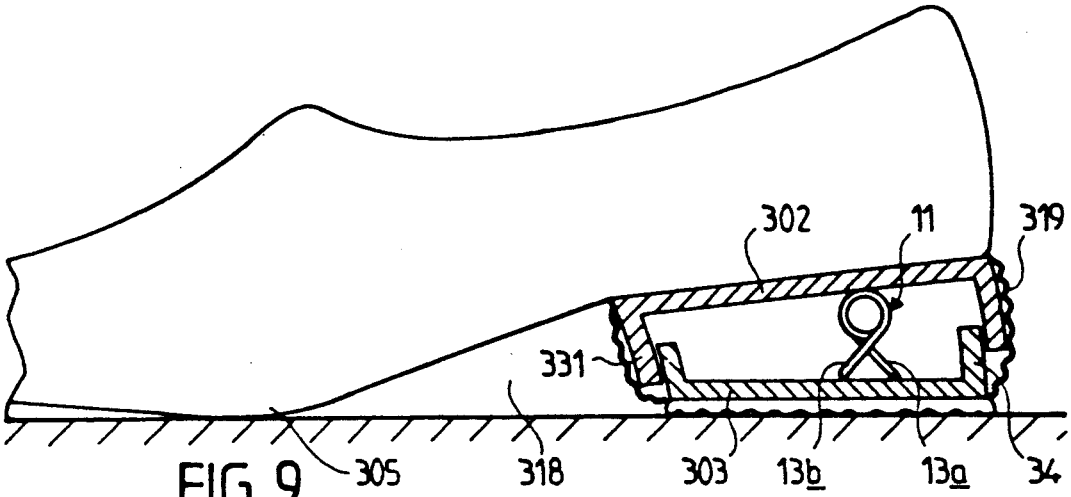
FIG. 9, like FIG. 7, shows a variation of a shoe designed for everyday wear.

FIG. 9 shows a variation of the shoe designed for everyday wear as shown in FIG. 7. The upper rigid plate 302 is limited by a rim 331 which surrounds the rim at 34 of the lower plate 303. The transversal sections of the rims 331 and 34 are curved and cylindrical, the horizontal axis being located adjacent to the area where the sole bends at 305. The spring 11 is set between plates 302 and 303, their location being restricted to the heel area. There is a gap 318 between this area 305 and the heel so that the heel is not in too much contact with the front of the cassette. A sort of gusset 319 surrounds the whole of plates 302 and 303.

Figure 10:
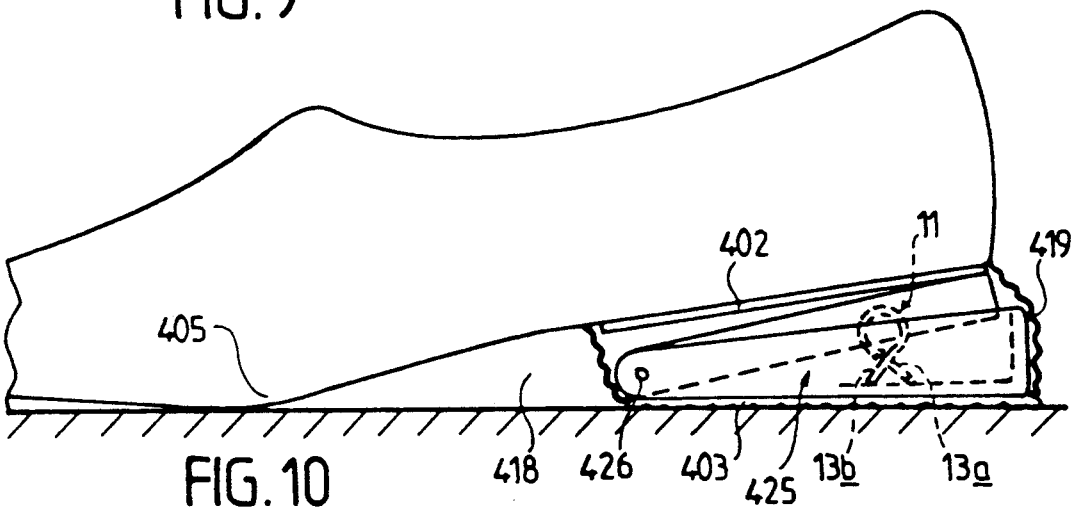
FIG. 10, like FIG. 9, shows another variation of a shoe designed for everyday use.

FIG. 10 shows a variation of an everyday shoe, including, in the heel a cassette 425, similar to the cassette in FIG. 5, but which are shorter in length. The axis for articulation 426 is located in the area of the front edge of the heel, the spring 11 being located towards the back. The cassette is placed between an upper rigid plate 402 and a lower rigid plate 403. The whole is encased by a sort of gusset 419. The area where the foot flexes is located in the area of the metatarsus and the gap 418.

Figure 11:
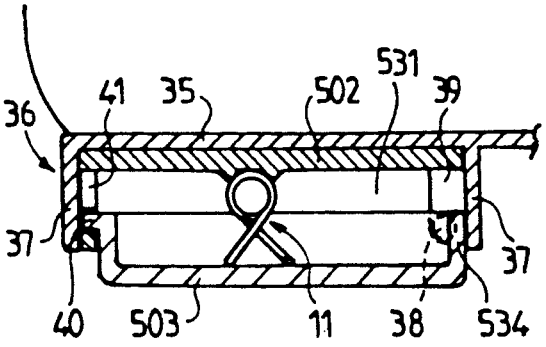
FIG. 11 shows a longitudinal cross section of the heel of another variation of a shoe designed for everyday use.
Figure 12:
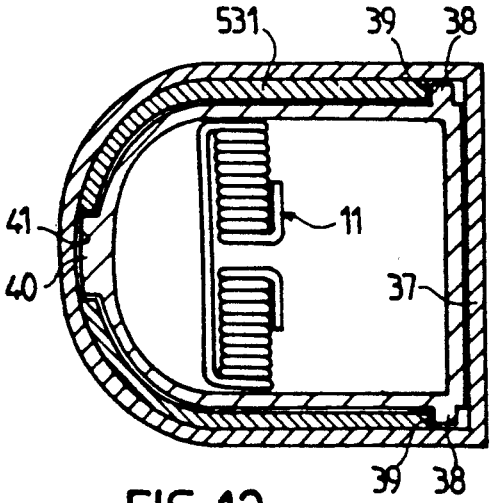
FIG. 12 shows a horizontal section, seen from above, of the heel shown in FIG. 11.

FIGS. 11 and 12 illustrate another variation of the heel of the shoe.

The upper rigid plate 502 is placed against the upper wall 35 of a solid envelope 36 on the sole and including a vertical periphery wall 37 which points downwards. Plate 502 has a vertical rim 531 around all edges but its front transversal edge.

The lower plate 503, made of a hard material like plate 502, forms a sort of upturned cover with its rim 534 pointing upwards, situated inside the lining wall 37 and the rim 531. Plate 503 may move more or less vertically in relation to plate 502. A dog point 38 jutting out at each side has been included, at the front and at the top of the longitudinal sections of the rim 534. Each dog point will be set into a vertical groove 39 on the internal side of the rim 534, and will be closed at the bottom. At the back of the plate 503, at the top of its rim, there is a tappet 40 jutting out towards the back, also set into a groove or a gap 41 and closed at the bottom, of the rim 534.

The spring 11 will be set between plates 502 and 503 in a similar fashion to the method described previously.

Figure 13:
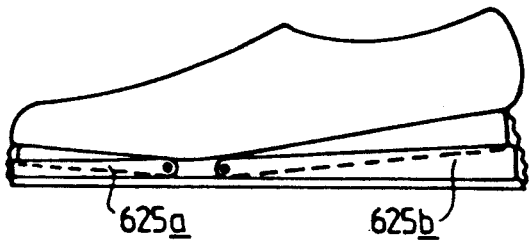
FIG. 13 shows a diagram of the side of another variation of the shoe.
Figure 4:
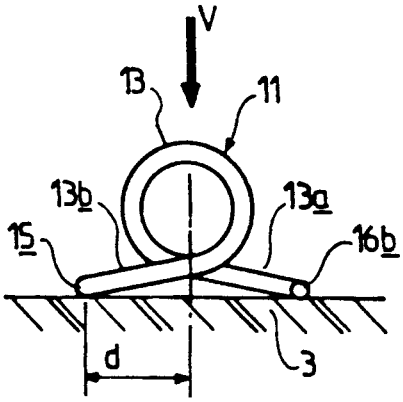
FIG. 4 shows the spring from FIG. 3 when crushed.

FIG. 13 shows a shoe the sole of which includes a cassette **625*a* similar to the cassette 25 in FIG. 6, but shorter in length, located in front of the metatarsus of the foot and set in back to front. In other words, the angle of the cassette 625*a* is slightly in front of the metatarsus, whilst the spring in the cassette 625*a* will be underneath the point of the shoe. The spring range of the spring in the cassette 625*a*** is not as great as the range of the spring under the heel; this range may be 3 or 4 mm for example.

This cassette **625*a* may be combined with a second spring 625*b*, set in like the cassette 25 in FIGS. 5 and 6, that is to say with the angle pointing towards the front and its spring under the heel. The spring in cassette 625*b*** will given a spring range of 6 to 7 mm.

As a variation, cassette **625*a* may be combined with a rear section of the sole similar to the one shown in FIG. 1**.

Whatever the type of shoe made, a shoe made in accordance with the invention, production will be simple and will ensure good cushioning against shocks to the heel from the ground with optimum restitution of energy stored during the shock. Rubbing of the foot against the upper of the shoe, notably in the area of the heel, will be alleviated despite the elasticity provided in the area of the heel.

I claim:

1. A shoe having a heel portion including a first planar plate adjacent said heel portion and a second planar plate located on a side of said first plate facing away from said heel portion, said first plate being fixed relative to said heel portion while said second plate is movable relative to said first plate and heel portion, spring means located between said plates to cushion against shocks from contact with the ground, said spring means comprising a torsion spring having at least one coil having a longitudinal axis extending generally parallel to said first and second plates, said coil having opposite ends and an arm extending radially from each said end relative to said longitudinal axis and with said arms forming an angle between said arms, said arms having ends spaced from said longitudinal axis with said ends of said arms slidably engaging one of said plates, said coil being in contact with the other said plate and being movable toward and away from said one plate when a load is applied, said angle between said arms being such that, when said plates move towards one another, said coil will be moved generally orthogonally relative to said one plate and the angle between said arms will increase in proportion to the load applied and will decrease as the load is decreased, said arms extending to substantially the same length from said coil and said angle between said arms being approximately 60° when said torsion spring is at rest with the angle between each arm and a vertical axis being approximately 30°.

2. The shoe as claimed in claim 1 wherein said shoe has a sole including a forward end, a metatarsal region and said heel portion including a rear end of said shoe, said first plate being rigid and attached to said sole adjacent said heel portion, said sole including a transverse line extending across the width of said sole in said metatarsal region with said first plate lying on one side of said line, said first plate being movable about said transverse line to vary an angle between said forward end of said sole and said first plate, said shoe having a gusset for the foot with said gusset having an edge attached to said first plate, said spring means being disposed between said plates at the heel portion of said shoe, said first plate extending from said transverse line to said heel portion.

3. The shoe as claimed in claim 2 wherein the spring means has a spring constant such that the spring force resisting flexing during the first millimeter of movement, corresponding to a weight on the spring on the order of 35 dan and that after a compression of the spring on the order of 6–7 mm, the weight on the spring has only doubled to thereby provided a good absorber of shocks.

4. The shoe as claimed in claim 2 wherein said second plate is rigid and has a exterior surface covered with a material for contacting the ground that is more flexible than said second plate.

5. The shoe as claimed in claim 2 wherein the dimensions of said first and second plates are approximately the same.

6. The shoe as claimed in claim 1 wherein said spring means includes another coil disposed on said longitudinal axis and spaced from said at least one coil, each said coil having at opposite ends said radial arm with said arms at an axially outermost end of said coils being connected by a connecting arm extending generally parallel to said longitudinal axis.

7. The shoe as claimed in claim 6 wherein said first plate includes an elongated partially circular groove for receiving a portion of each of said coils to minimize movement of said coils relative to said first plate.

8. The shoe as claimed in claim 6 wherein said arms at an axially inner end of said respective coils are bent to extend in opposite directions from one another.

9. The shoe as claimed in claim 1 further including a triangularly shaped prism body in the form of dihedron having an apex and having two flat faces wherein one flat face of said body is said first plate and the other flat face of said body is said second plate with said spring means being disposed between said plates, each plate having one end with said ends of said plates being articulated together, said shoe having an upper and a lower sole with said body being inserted between a portion of said soles, said soles being enclosed by a gusset that is flexible to allow for movement of said plates toward and away from eachother.

10. The shoe as claimed in claim 9 wherein said body has dimensions such that said apex of said body is disposed adjacent the metatarsal region of said shoe and said spring means is located adjacent the heel of the shoe.

11. The shoe as claimed in claim 1 wherein said first and second plates are each U shaped in cross section with side walls on opposite sides of each plate, each plate having a different width dimension allowing said side walls of one plate to fit within the side walls of the other of said plates.

12. The shoe as claimed in claim 11 wherein said side walls of said plates include retaining means for preventing separation of said plates but allowing limited relative angular movement therebetween.

13. The shoe as claimed in claim 1 wherein said first plate is provided with a transverse groove receiving a portion of said coil to prevent movement of said coil relative to said first plate.

14. The shoe as claimed in claim 1 wherein said torsion spring extends transversely across substantially the entire width of the heel of said shoe so as to provide good lateral stability with the axis of said coil extending generally horizontally.

* * * * *